US007985092B2

(12) United States Patent
Suzuki et al.

(10) Patent No.: US 7,985,092 B2
(45) **Date of Patent: *Jul. 26, 2011**

(54) CONNECTION STRUCTURE

(75) Inventors: Sachio Suzuki, Hitachi (JP); Hideaki Takehara, Hitachi (JP); Kunihiro Fukuda, Tsukuba (JP); Yuta Kataoka, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/662,803

(22) Filed: May 4, 2010

(65) Prior Publication Data

US 2011/0130021 A1 Jun. 2, 2011

(30) Foreign Application Priority Data

Nov. 30, 2009 (JP) ..... 2009-272317

(51) Int. Cl.
*H01R 13/62* (2006.01)

(52) U.S. Cl. ..... 439/346

(58) Field of Classification Search ..... 439/346, 439/359

See application file for complete search history.

(56) References Cited

U.S. PATENT DOCUMENTS

| | | | | | |
|---|---|---|---|---|---|
| 2,956,139 | A | * | 10/1960 | Paddock | 200/246 |
| 4,136,919 | A | * | 1/1979 | Howard et al. | 439/346 |
| 5,692,921 | A | * | 12/1997 | Jennings | 439/346 |
| 2009/0075506 | A1 | | 3/2009 | Suzuki | |

FOREIGN PATENT DOCUMENTS

| | | |
|---|---|---|
| JP | 2004-56924 | 2/2004 |
| JP | 4037199 | 11/2007 |
| JP | 2009-70754 | 4/2009 |

* cited by examiner

*Primary Examiner* — Gary F. Paumen
(74) *Attorney, Agent, or Firm* — McGinn IP Law Group, PLLC

(57) ABSTRACT

A connection structure includes a male terminal housing with first connecting terminals, a female terminal housing with second connecting terminals, isolating plates in the male terminal housing, a connecting member to thereby collectively fix the first connecting terminals and the second connecting terminals at the contacts therebetween for electrical connections between the first connecting terminals and the second connecting terminals, and manipulation permitting means for permitting manipulation of the connecting member for collectively fixing the first connecting terminals and the second connecting terminals at the contacts therebetween respectively, when the male terminal housing and the female terminal housing are mated with each other in a specified mated state.

8 Claims, 5 Drawing Sheets

4a-4c FIRST CONNECTING TERMINAL
5 MALE TERMINAL HOUSING
6a-6c SECOND CONNECTING TERMINAL
7 FEMALE TERMINAL HOUSING
8a-8d ISOLATING PLATE
9 CONNECTING MEMBER
9c MANIPULATION TOOL ENGAGING HOLE
40 CONNECTING MEMBER MANIPULATION HOLE 4a-4c FIRST CONNECTING TERMINAL
5 MALE TERMINAL HOUSING
8a-8d ISOLATING PLATE
9 CONNECTING MEMBER
9c MANIPULATION TOOL ENGAGING HOLE 6a-6c SECOND CONNECTING TERMINAL
7 FEMALE TERMINAL HOUSING
40 CONNECTING MEMBER MANIPULATION HOLE 4a-4c FIRST CONNECTING TERMINAL
5 MALE TERMINAL HOUSING
6a-6c SECOND CONNECTING TERMINAL
7 FEMALE TERMINAL HOUSING
8a-8d ISOLATING PLATE
9 CONNECTING MEMBER
9c MANIPULATION TOOL ENGAGING HOLE
40 CONNECTING MEMBER MANIPULATION HOLE

9 CONNECTING MEMBER
9b HEAD
14 PACKING
15 ELASTIC MEMBER
44 SCREWING PORTION
45 FEMALE SCREW
46 ELASTIC MEMBER HOLDING PORTION

CONNECTION STRUCTURE

The present application is based on Japanese patent application No. 2009-272317 filed on Nov. 30, 2009, the entire contents of which are incorporated herein by reference.

BACKGROUND OF THE INVENTION

1. Field of the Invention

The present invention relates to a connection structure, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal.

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP Patent No. 4037199, is known in the art.

JP Patent No. 4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor. The technique used in the electrical connection structure disclosed by JP Patent No. 4037199 is as follows: Each phase connecting terminal of the conductive member and each corresponding phase connecting terminal of the power line cable are overlapped, and isolating members are disposed on opposite surfaces to the overlapped surfaces of the connecting terminals, respectively, and these overlapped connecting terminals and isolating members are collectively fastened in an overlapping direction with a single bolt provided in a position to penetrate these overlapped connecting terminals and isolating members.

That is, in the technique used in the electrical connection structure disclosed by JP Patent No. 4037199, the single bolt is tightened in the overlapping direction, to collectively hold the multiplicity of contacts between the connecting terminals, which are the overlapped surfaces of the connecting terminals, and thereby fix the connecting terminals at the contacts therebetween, for electrical connections between the connecting terminals, respectively. This configuration disclosed by JP Patent No. 4037199 is effective in easily ensuring size reduction, compared to a technique disclosed by JP-A-2009-070754.

Refer to JP-A-2009-070754 and JP Patent No. 4037199, for example.

However, the electrical connection structure disclosed by JP Patent No. 4037199 has the following problem.

The electrical connection structure disclosed by JP Patent No. 4037199 is likely to cause electrical connection failure, because the bolt can be tightened, even with the connecting terminals being not inserted in specified positions, respectively. From the point of view of safety, it is desirable to eliminate such connection failure, especially, in power harnesses, which are used for large power transmission.

SUMMARY OF THE INVENTION

Accordingly, it is an object of the present invention to provide a connection structure with a multiplicity of first connecting terminals, a multiplicity of second connecting terminals, and a multiplicity of isolating plates to be stacked therein, which, only when the corresponding first and second connecting terminals are disposed in specified positions respectively, permits each contact between the first and the second connecting terminals to be easily pressed by a connecting member, and which is thereby unlikely to cause electrical connection failure.

(1) According to one embodiment of the invention, a connection structure comprises:

a male terminal housing with a plurality of first connecting terminals aligned and accommodated therein;

a female terminal housing with a plurality of second connecting terminals aligned and accommodated therein;

a plurality of isolating plates aligned and accommodated in the male terminal housing;

when the male terminal housing and the female terminal housing are mated with each other, the plural first connecting terminals and the plural second connecting terminals facing each other to form pairs, respectively, and resulting in a stacked structure of the pairs of the first connecting terminals and the second connecting terminals alternately interleaved with the plural isolating plates;

a connecting member comprising a head and a shaft connected to the head, the shaft penetrating each contact between the plural first connecting terminals and the plural second connecting terminals and the plural isolating plates, the head pressing the adjacent isolating plate, to thereby collectively fix the plural first connecting terminals and the plural second connecting terminals at the contacts therebetween, for electrical connections between the plural first connecting terminals and the plural second connecting terminals, respectively, at least a portion of the connecting member, which penetrates each contact, being formed of an insulating material; and manipulation permitting means for permitting manipulation of the connecting member for collectively fixing the plural first connecting terminals and the plural second connecting terminals at the contacts therebetween respectively, when the male terminal housing and the female terminal housing are mated with each other in a specified mated state.

(2) According to another embodiment of the invention, a connection structure comprises:

a male terminal housing with a plurality of first connecting terminals aligned and accommodated therein;

a female terminal housing with a plurality of second connecting terminals aligned and accommodated therein;

a plurality of isolating plates aligned and accommodated in the male terminal housing;

when the male terminal housing and the female terminal housing are mated with each other, the plural first connecting terminals and the plural second connecting terminals facing each other to form pairs, respectively, and resulting in a stacked structure of the pairs of the first connecting terminals and the second connecting terminals alternately interleaved with the plural isolating plates;

a connecting member comprising a head for pressing the adjacent isolating plate, to thereby collectively fix the plural first connecting terminals and the plural second connecting terminals at the contacts therebetween, for electrical connections between the plural first connecting terminals and the plural second connecting terminals, respectively; and manipulation permitting means for permitting manipulation of the connecting member for collectively fixing the plural first connecting terminals and the plural second connecting terminals at the contacts therebetween respectively, when the male terminal housing and the female terminal housing are mated with each other in a specified mated state.

In the above embodiments (1) and (2), the following modifications and changes can be made.

(i) The manipulation permitting means comprises a manipulation tool engaging hole formed in the head of the connecting member, into which is engaged a specified manipulation tool, and a connecting member manipulation hole formed in the female terminal housing, and having substantially the same size shape as the manipulation tool engaging hole, wherein the connecting member manipulation hole is formed in the female terminal housing so that when the male terminal housing and the female terminal housing are mated with each other in the specified mated state, the manipulation tool engaging hole and the connecting member manipulation hole are aligned with each other, and wherein the manipulation permitting means permits manipulation for fixing the plural first connecting terminals and the plural second connecting terminals at the contacts therebetween respectively to the connecting member, when the manipulation tool engaging hole and the connecting member manipulation hole are aligned with each other.

(ii) The connection structure further comprises:

a metallic elastic member for, when the connecting member is inserted into the male terminal housing, being disposed between the head and the isolating plate disposed directly below the head, the elastic member applying a specified pressing force to that isolating plate disposed directly below the head, to press the plural isolating plates sequentially in a stacking direction; and a recessed portion for accommodating a lower portion of the elastic member pressing that isolating plate, the recessed portion being formed in an upper surface of that isolating plate disposed directly below the head.

(iii) The connection structure further comprises:

a metallic receiving member for receiving the elastic member, the receiving member being provided at the bottom of the recessed portion.

(iv) The connection structure further comprises:

a connecting member insertion hole for inserting the connecting member, the connecting member insertion hole being formed in the male terminal housing; and a waterproofing structure for sealing between an outer surface of the head and an inner surface of the connecting member insertion hole in the male terminal housing, the waterproofing structure being provided in an outer surface of the head of the connecting member.

(v) The connecting member insertion hole is formed in a cylindrical shape, and bent inward at an end of the cylindrical shape facing into the male terminal housing, and a rim of a lower surface of the head of the connecting member is contacted with the bent end of the connecting member insertion hole, to thereby regulate the stroke of the connecting member.

(vi) The plural second connecting terminals are connected with flexible cables, respectively, at one end, and the female terminal housing further comprises a cable holding member for holding the cables, so that the plural second connecting terminals are held at specified positions, respectively, with flexibility relative to the female terminal housing.

Points of the Invention

According to one embodiment of the invention, there is provided a manipulation permitting means for permitting manipulation for fixing the first connecting terminals and the second connecting terminals at the contacts therebetween respectively relative to a connecting member, when a male terminal housing and a female terminal housing are mated with each other in a specified mated state. Therefore, the contacts between the connecting terminals (i.e. the first connecting terminals and the second connecting terminals) can easily be pressed by the connecting member, only when the connecting terminals (i.e. the first connecting terminals and the second connecting terminals) are disposed at the specified positions, respectively. Thus, the electrical connection failures can be prevented.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a first embodiment, referring to the accompanying drawings.

Herein is described a connector as one example of a connection structure of the invention.

First Embodiment

Figure 1:
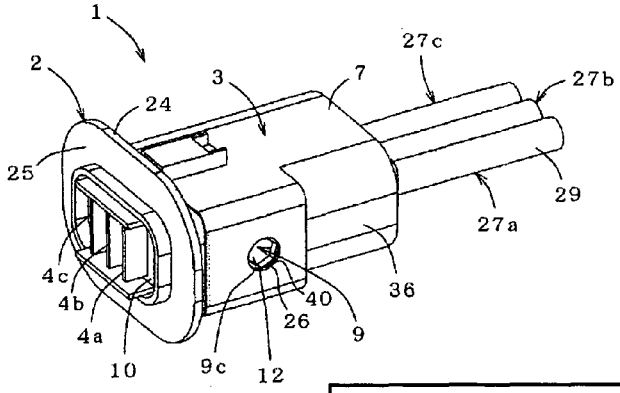
FIG. 1 is a perspective view showing a connector in a first embodiment according to the invention.
Figure 2:
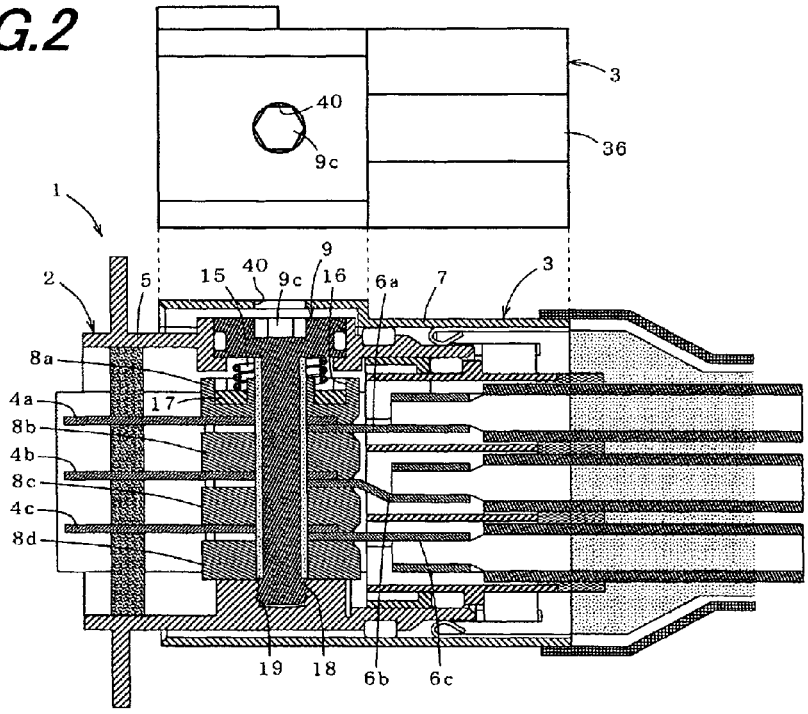
FIG. 2 is a cross-sectional view showing the connector of FIG. 1.

FIG. 1 is a perspective view showing the connector in the first embodiment according to the invention, and FIG. 2 is a cross-sectional view showing the connector of FIG. 1.

Connector 1 Structure

As shown in FIGS. 1 and 2, the connector 1 in this embodiment is constructed of a first connector portion 2 and a second connector portion 3 mated with each other, to thereby collectively connect a plurality of power lines.

More specifically, the connector 1 includes the first connector portion 2 having a male terminal housing 5 with a plurality of (three) first connecting terminals (male terminals) 4*a* to 4*c* aligned and accommodated therein, the second connector portion 3 having a female terminal housing 7 with a plurality of (three) second connecting terminals (female terminals) 6*a* to 6*c* aligned and accommodated therein, and a plurality of isolating plates 8*a* to 8*d* aligned and accommodated in the male terminal housing 5. When the male terminal housing 5 of the first connector portion 2 and the female terminal housing 7 of the second connector portion 3 are mated with each other, the plural first connecting terminals 4*a* to 4*c* and the plural second connecting terminals 6*a* to 6*c* face each other to form pairs, respectively (i.e. each pair of the first connecting terminal 4*a* and the second connecting terminal 6*a*, the first connecting terminal 4*b* and the second connecting terminal 6*b*, and the first connecting terminal 4*c* and the second connecting terminal 6*c*), and result in a stacked structure of the pairs of the first connecting terminals 4*a* to 4*c* and the second connecting terminals 6*a* to 6*c* alternately interleaved with the plural isolating plates 8*a* to 8*d*. That is, mating the male terminal housing 5 of the first connector portion 2 and the female terminal housing 7 of the second connector portion 3 results in the connector 1 in this embodiment in which are stacked the plural first connecting terminals 4*a* to 4*c* and the plural second connecting terminals 6*a* to 6*c* and the plural isolating plates 8*a* to 8*d*.

This connector 1 is used for connection of a vehicle drive motor and an inverter for diving that motor, for example.

More specifically, the male terminal housing 5 of the first connector portion 2 (in FIG. 1, left side portion) is mated with a shield case of the motor, and the first connecting terminal 4*a* to 4*c* portions exposed from the male terminal housing 5 are connected to terminals, respectively, of a terminal block installed in the shield case of the motor. Mating to this first connector portion 2 the second connector portion 3 electrically connected with the inverter results in electrical connection of the motor and the inverter. Although the foregoing is concerned with the motor side connection, the same applies to the inverter side connection.

First and Second Connector Portions 2 and 3

Below are described the respective specific structures of the first connector portion 2 and the second connector portion 3.

First Connector Portion 2

Figure 3:
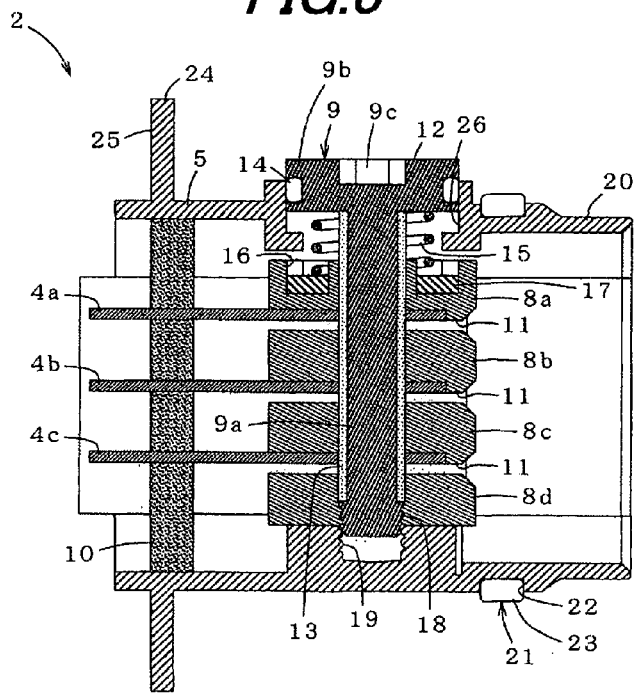
FIG. 3 is a cross-sectional view showing a first connector portion.

Referring to FIG. 3, the first connector portion 2 has the three first connecting terminals 4*a* to 4*c* held therein to be aligned at a specified pitch, and includes the male terminal housing 5 for accommodating the three aligned first connecting terminals 4*a* to 4*c*, the plural substantially rectangular parallelepiped isolating plates 8*a* to 8*d* provided in the male terminal housing 5 for isolating each of the first connecting terminals 4*a* to 4*c*, and a connecting member 9 with a head 9*b* and a shaft 9*a* connected to the head 9*b*, whose shaft 9*a* penetrates each contact between the plural first connecting terminals 4*a* to 4*c* and the plural second connecting terminals 6*a* to 6*c* and the plural isolating plates 8*a* to 8*d*, and whose head 9*b* is pressed against the adjacent isolating plate 8*a*, to thereby collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively. At least a portion of the connecting member 9, which penetrates each contact, is formed of an insulating material.

First Connecting Terminals 4*a* to 4*c*

The first connecting terminals 4*a* to 4*c* are plate terminals, and are held to be aligned at a specified pitch by being spaced apart from each other by a molded resin material 10 formed of an insulating resin (e.g. PPS (polyphenylene sulfide) resin, PPA (polyphthalamide) resin, PA (polyamide) resin, PBT (polybutylene terephthalate), epoxy based resin), which forms a portion of the male terminal housing 5. As a method for holding the first connecting terminals 4*a* to 4*c* with the molded resin material 10, there is a holding method by inserting the first connecting terminals 4*a* to 4*c* during molding of the molded resin material 10 and then curing the resin, or a holding method by pressing the first connecting terminals 4*a* to 4*c* into the molded resin material 10 which has been molded beforehand.

The first connecting terminals 4*a* to 4*c* are supplied with electricity at different voltages and/or currents, respectively. For example, in this embodiment, power lines are assumed to be for three phase alternating current between a motor and an inverter, so that the first connecting terminals 4*a* to 4*c* are supplied with alternating currents, respectively, which are 120 degrees out of phase with each other. For the purpose of reducing the loss of power transmitted through the connector 1, the first connecting terminals 4*a* to 4*c* may each be formed of a metal such as a high conductivity silver, copper, aluminum, or the like. Also, the first connecting terminals 4*a* to 4*c* each have slight flexibility.

Isolating Plates 8*a* to 8*d*

The plural isolating plates 8*a* to 8*d* comprise the plurality of first isolating plates 8*a* to 8*c* aligned and accommodated in the male terminal housing 5, and integrally fixed to one side of the plural first connecting terminals 4*a* to 4*c*, respectively, (i.e. to the opposite side to the side joined with the second connecting terminals 6*a* to 6*c*), and the second isolating plate 8*d* provided to be integrally fixed to an inner surface of the male terminal housing 5, and to face one side of the second connecting terminal 6*c* (i.e. the opposite side to the side joined with the first connecting terminal 4*c*) positioned at the outermost side when stacking the plural first connecting terminals 4*a* to 4*c* and the plural second connecting terminals 6*a* to 6*c*.

Figure 4A:
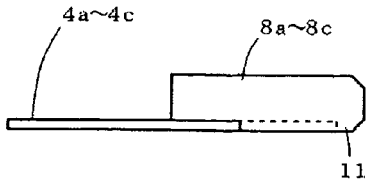
FIGS. 4A and 4B are a side view and a bottom view, respectively, showing a first connecting terminal.
Figure 4B:
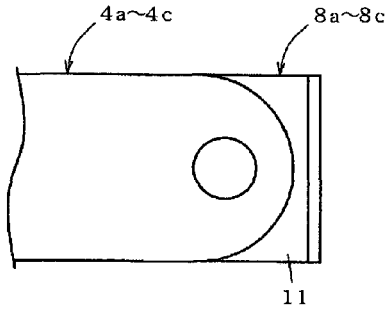

The plural isolating plates 8*a* to 8*d* are fixed at such a position as to protrude from the tips of the first connecting terminals 4*a* to 4*c*. Each of these isolating plates 8*a* to 8*d* is chamfered at each of its corners on the second connecting terminal 6*a* to 6*c* inserting/removing side. Also, referring to FIGS. 4A and 4B, each of the plural first isolating plates 8*a* to 8*c* is formed with a protruding portion (thickened surface) 11 of its surface fixed to the first connecting terminals 4*a* to 4*c* to fill the level difference therebetween, so that the lower surfaces (in the figure, the lower sides) of the plural first isolating plates 8*a* to 8*c* are coplanar with the lower surfaces (in the figure, the lower sides) of the first connecting terminals 4*a* to 4*c*, respectively. With this configuration, when the first connector portion 2 and the second connector portion 3 are mated with each other, the tips of the first connecting terminals 4*a* to 4*c* do not contact the inserted tips of the second connecting terminal 6*a* to 6*c*. The insertability of the second connecting terminal 6*a* to 6*c* is therefore enhanced. In FIG. 4A, the structure of the first isolating plate 8*a* is depicted as being simplified, and the first isolating plates 8*a* to 8*c* are depicted likewise.

Connecting Member 9

Referring again to FIG. 3, the connecting member 9 has the shaft 9*a* with a portion, which penetrates each contact between the plural first connecting terminals 4*a* to 4*c* and the plural second connecting terminals 6*a* to 6*c*, formed of an insulating material, and the head 9*b* formed integrally with the shaft 9*a*, which serves as a pressing portion to be pressed against the adjacent first isolating plate 8*a*.

More specifically, the connecting member 9 comprises a bolt (cap bolt) 12 made of a metal (e.g. SUS, iron, copper alloy, or the like) and an insulating layer 13 formed of an insulating resin material (e.g. PPS (polyphenylene sulfide) resin, PPA (polyphthalamide) resin, PA (polyamide) resin, PBT (polybutylene terephthalate), epoxy based resin), which coats the perimeter of the shaft 9*a* (including the portion penetrating each contact) of that bolt 12.

The entire connecting member 9 formed of an insulating resin may be used, but the connecting member 9 coated with the insulating layer 13 around the perimeter of the shaft 9*a* of the metallic bolt 12 is preferable from the point of view of strength. That is, the connecting member 9 having the combined structure of the metallic bolt 12 and the insulating layer 13 made of an insulating resin can have enhanced strength, compared to the entire connecting member 9 formed of an insulating resin. As the insulating resin for coating the metallic bolt 12, it is preferred to use an insulating resin, which has a linear expansion coefficient approximate to a linear expansion coefficient of a metal forming the bolt 12, to prevent creep.

The head 9*b* on the central shaft of the connecting member 9 is formed with a manipulation tool engaging hole 9*c* in its upper surface (more specifically, at the center of the upper surface), into which is engaged a specified manipulation tool. The manipulation tool engaging hole 9*c* is, for example, a hexagonal hole, a driver groove, or the like, which is for engaging the specified manipulation tool when tightening the connecting member 9. In this embodiment, the manipulation tool engaging hole 9*c* is a hexagonal hole, because the cap bolt, specifically, the bolt with a hexagonal hole is used as the connecting member 9.

The head 9*b* of the connecting member 9 is provided with a packing 14 therearound for preventing water from penetrating into the male terminal housing 5. Also, between the lower surface of the head 9*b* of the connecting member 9 and the upper surface of the first isolating plate 8*a* directly therebelow is provided an elastic member 15 for applying a specified pressing force to the first isolating plate 8*a*. The elastic member 15 is a spring made of a metal (e.g. SUS, or the like). In this embodiment, the elastic member 15 constitutes a portion of the connecting member 9.

The first isolating plate 8*a* to be in contact with a lower portion of the elastic member 15 is formed with a recessed portion 16 in its upper surface which covers (accommodates) the lower portion of the elastic member 15. At the bottom of the recessed portion 16 (i.e. the base to be in contact with the lower portion of the elastic member 15) is provided a receiving member 17 made of a metal (e.g. SUS, or the like) which receives the elastic member 15 and which is for preventing damage to the first isolating plate 8*a* formed of an insulating resin.

The receiving member 17 prevents damage to the first isolating plate 8*a* by dispersing stress applied to the upper surface of the first isolating plate 8*a* from the elastic member 15. It is therefore preferred to make the contact area between the receiving member 17 and the first isolating plate 8*a* as large as possible. In this embodiment, to make the contact area between the receiving member 17 and the first isolating plate 8*a* large, the receiving member 17 shaped in a manner that contacts the entire surface of the bottom of the recessed portion 16 is provided.

This connecting member 9 is inserted into the male terminal housing 5 from above the first connecting terminal 4*a* to 4*c* surfaces (in FIG. 3, the upper surfaces) to which are fixed the first isolating plates 8*a* to 8*c*, respectively. A screwing portion 18 at a tip of the shaft 9*a* is then screwed into a screw hole 19 formed in an inner surface of the male terminal housing 5, to thereby allow the connecting member 9 to press the plural first connecting terminals 4*a* to 4*c* and the plural second connecting terminals 6*a* to 6*c* from its head 9*b* toward the tip of its shaft 9*a* (in FIG. 3, downward from above), and collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively.

Male Terminal Housing 5

The male terminal housing 5 is formed of a cylindrical hollow body 20 which is substantially rectangular in transverse cross section. An outer portion at one end (in the figure, at the right end) of the cylindrical body 20 mated with the female terminal housing 7 is formed in a tapered shape, taking the mateability with the second connector portion 3 into consideration. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (in the figure, in the left end) of the cylindrical body 20 is accommodated a molded resin material 10 with the first connecting terminals 4*a* to 4*c* aligned and held therewith. In an outer portion at the other end of the cylindrical body 20 is formed a flange 24 (an attachment hole omitted) for fixing the first connector portion 2 to a device chassis (e.g. a motor shield case). At a rim 25 of the flange 24 having the attachment hole for bolt insertion and fixation to a device chassis may be provided a packing for sealing between the first connector portion 2 and the device chassis. The structure of this flange 24 is not assumed as fixing the first connector portion 2 to a device chassis, but the flange 24 may be provided in the second connector portion 3, or in both the first connector portion 2 and the second connector portion 3. Also, both of the first connector portion 2 and the second connector portion 3 may be free or not fixed to a device chassis.

Also, this flange 24 is effective in enhancing the dissipation of heat. That is, the formation of the flange 24 permits a large surface area of the male terminal housing 5, thereby allowing enhancement in the dissipation to outside via the male terminal housing 5, of heat produced inside the first connector portion 2 (e.g. heat produced at each contact).

In an upper portion (in the figure, in the upper side) of the cylindrical body 20 is formed a connecting member insertion hole 26 for inserting the connecting member 9. The connecting member insertion hole 26 is formed in a cylindrical shape, and bent inward at a lower end (in the figure, at the lower side) of that cylindrical shape. A rim of the lower surface of the head 9*b* of the connecting member 9 is contacted with this bent portion of the connecting member insertion hole 26, to thereby regulate the stroke of the connecting member 9.

For shielding performance, heat dissipation, and weight reduction of the connector 1, the cylindrical body 20 is formed of, preferably a high electrical conductivity, high thermal conductivity and lightweight metal such as an aluminum, but may be formed of a resin, or the like. In the case that the male terminal housing 5 is formed of an insulating resin, the second isolating plate 8*d* and the male terminal housing 5 may integrally be formed of the insulating resin. The cylindrical body 20 formed of an aluminum as mentioned above allows the connecting member 9 to be firmly tightened into the screw hole 19 when screwed thereinto, compared with the cylindrical body 20 formed of an insulating resin.

Second Connector Portion 3

Figure 5:
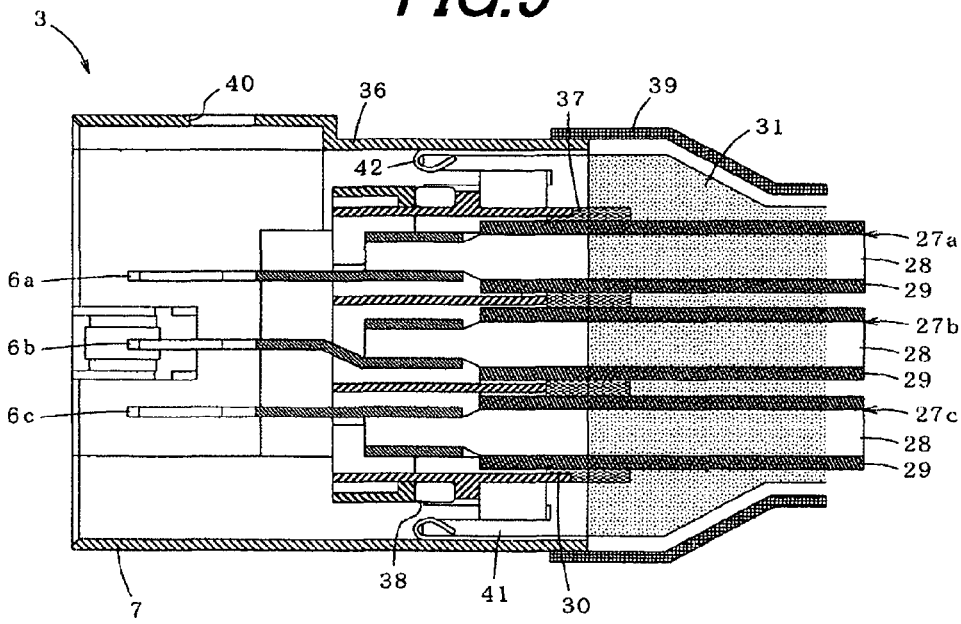
FIG. 5 is a cross-sectional view showing a second connector portion.

Referring to FIG. 5, the second connector portion 3 has the female terminal housing 7 with a plurality of (three) second connecting terminals (female terminals) 6*a* to 6*c* aligned and accommodated therein.

The second connecting terminals 6*a* to 6*c* are connected with cables 27*a* to 27*c*, respectively, at one end, which extend from an inverter. These cables 27*a* to 27*c* are electrically connected to the first connecting terminals 4*a* to 4*c* via the second connecting terminals 6*a* to 6*c*, respectively, and therefore supplied with electricity at voltages and/or currents in correspondence to the second connecting terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held to be aligned at a specified pitch by a multi-cylindrical cable holding member 30. With this cable holding member 30, when the first connector portion 2 and the second connector portion 3 are mated with each other, the second connecting terminals 6*a* to 6*c* are held to be positioned below the first connecting terminals 4*a* to 4*c* to face (i.e. to be connected to) the second connecting terminals 6*a* to 6*c* to form pairs respectively.

The cable holding member 30 is formed of an insulating resin, to isolate the second connecting terminals 6*a* to 6*c* from each other to prevent a short circuit. This cable holding member 30 allows the second connecting terminals 6*a* to 6*c* to be held at specified positions respectively, even when the cables 27*a* to 27*c* respectively connected to the second connecting terminals 6*a* to 6*c* have excellent flexibility. That is, in this embodiment, the cables 27*a* to 27*c* to be used can have excellent flexibility, and therefore enhance a degree of freedom of wiring the cables 27*a* to 27*c*.

Although the second connecting terminals 6*a* to 6*c* are positioned by the cable holding member 30 holding the cables 27*a* to 27*c*, more specifically, the ends near the second connecting terminals 6*a* to 6*c* of the cables 27*a* to 27*c* to hold the second connecting terminals 6*a* to 6*c* at specified positions respectively, the second connecting terminals 6*a* to 6*c* may be positioned by the cable holding member 30 holding the cables 27*a* to 27*c*, and the second connecting terminals 6*a* to 6*c* directly. Also, a connecting terminal holding member may, in place of the cable holding member 30, be used that holds not the cables 27*a* to 27*c*, but the second connecting terminals 6*a* to 6*c* directly.

In the case that, with the cable holding member 30, the second connecting terminals 6*a* to 6*c* are positioned by holding the cables 27*a* to 27*c* without directly holding the second connecting terminals 6*a* to 6*c*, that is, in the case of this embodiment, making the cables 27*a* to 27*c* flexible allows the tips of the second connecting terminals 6*a* to 6*c* to have flexibility relative to the female terminal housing 7. This construction permits flexible adaptation, even to deformation of first connecting terminal 4*a* to 4*c* portions to insert the second connecting terminals 6*a* to 6*c* in the first connector portion 2, when pressed by the connecting member 9.

Also, a braided shield 31 is wrapped around cables 27*a* to 27*c* portions drawn out of the female terminal housing 7, for the purpose of enhancement in shielding performance. This braided shield 31 is contacted with a later-described cylindrical shield body 41, and electrically connected to the male terminal housing 5 (an equipotential (GND)) through the cylindrical shield body 41. For simplification, no braided shield 31 is shown in FIG. 1.

Second Connecting Terminals 6*a* to 6*c*

Figure 6A:
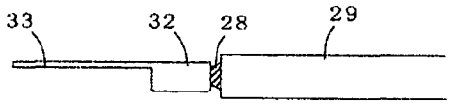
FIGS. 6A and 6B are a side view and a bottom view, respectively, showing a second connecting terminal.
Figure 6B:
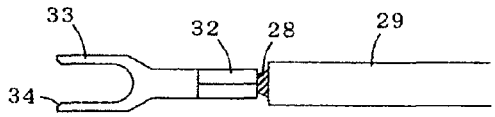
Figure 7A:
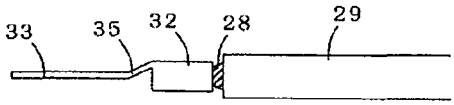
FIGS. 7A and 7B are a side view and a bottom view, respectively, showing a second connecting terminal.
Figure 7B:
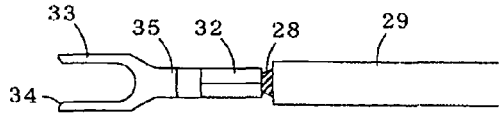

Referring to FIGS. 6 and 7, the second connecting terminals 6*a* to 6*c* respectively include calking portions 32 for calking the conductors 28 exposed from the tips of the cables 27*a* to 27*c*, and U-shaped contacts 33 formed integrally with the calking portions 32. At tips of the U-shaped contacts 33 are respectively formed tapered portions 34 to enhance the insertability of the U-shaped contacts 33. When the first connector portion 2 and the second connector portion 3 are mated with each other, the U-shaped contacts 33 are inserted in such a manner as to grip the shaft 9*a* of the connecting member 9.

In this embodiment, to reduce the size of the connector 1, the cables 27*a* to 27*c* are configured to be aligned and held as close to each other as possible. To this end, as shown in FIG. 7, a trunk 35 of the second connecting terminal 6*b* to be connected to the cable 27*b* arranged in the middle when aligned is bent, to thereby space the second connecting terminals 6*a* to 6*c* apart at the same pitch.

The second connecting terminals 6*a* to 6*c* may each be constructed of a high electrical conductivity metal such as silver, copper, aluminum, or the like, in order to reduce the loss of power transmitted through the connector 1. Also, the second connecting terminals 6*a* to 6*c* each have slight flexibility.

Female Terminal Housing 7

Referring again to FIG. 5, the female terminal housing 7 is formed of a cylindrical hollow body 36 which is substantially rectangular in transverse cross section. To mate the male terminal housing 5 into the female terminal housing 7, an inner portion at one end (in the figure, at the left end) of the cylindrical body 36 mated with the male terminal housing 5 is formed in a tapered shape, taking the mateability with the male terminal housing 5 into consideration.

In the other end (in the figure, in the right end) of the cylindrical body 36 is accommodated the cable holding member 30 with the cables 27*a* to 27*c* aligned and held therewith. On a cable insertion side of the cable holding member 30 is formed a packingless sealing portion 37, to prevent water from penetrating onto the cables 27*a* to 27*c* and into the female terminal housing 7. In an outer portion of the cable holding member 30 is provided a packing 38 to be in contact with an inner surface of the male terminal housing 5. That is, the connector 1 has a double waterproofing structure of the packing 23 of the terminal housing waterproofing structure 21 and the packing 38 provided in the outer portion of the cable holding member 30.

Further, the other end of the cylindrical body 36 from which the cables 27*a* to 27*c* are drawn out is covered with a rubber boot 39 for preventing water from penetrating into the cylindrical body 36. For simplification, no rubber boot 39 is shown in FIG. 1.

Also, in an upper portion (in the figure, in the upper side) of the cylindrical body 36 is formed a connecting member manipulation hole 40 for manipulating the connecting member 9 provided in the first connector portion 2 when the first connector portion 2 and the second connector portion 3 are mated with each other.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of an insulating resin. Therefore, to enhance its shielding performance and heat dissipation, the cylindrical shield body 41 made of aluminum is provided on an inner surface at the other end of the cylindrical body 36.

The cylindrical shield body 41 has a contact 42 to be contacted with an outer portion of the male terminal housing 5 made of an aluminum when the first connector portion 2 and the second connector portion 3 are mated with each other. The cylindrical shield body 41 is thermally and electrically connected with the male terminal housing 5 via this contact 42. This enhances the shielding performance and the heat dissipation. In particular, the heat dissipation is likely to be significantly enhanced by positively allowing heat to escape toward the male terminal housing 5 having an excellent heat dissipation property.

Connection between the first connecting terminals 4*a* to 4*c* and the second connecting terminals 6*a* to 6*c*

Next is described the connection between the first connecting terminals 4*a* to 4*c* and the second connecting terminals 6*a* to 6*c* using the connector 1 in this embodiment.

Figure 8:
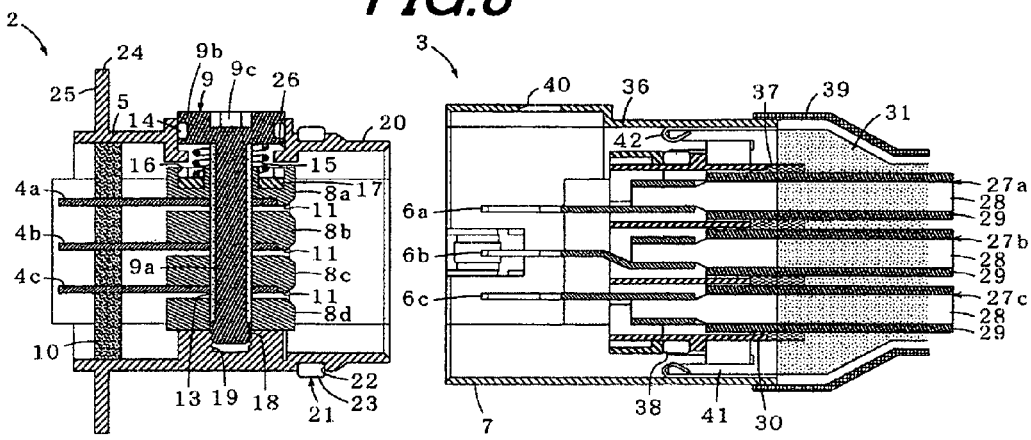
FIG. 8 is a cross-sectional view showing the connector before mating the first connector portion and the second connector portion.

Referring to FIG. 8, when the first connector portion 2 and the second connector portion 3 are mated with each other from an unmated state as shown, the second connecting terminals 6*a* to 6*c* are inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form pairs respectively. With that insertion, the plural first connecting terminals 4*a* to 4*c* and the plural second connecting terminals 6*a* to 6*c* then face each other to form pairs, respectively, and result in a stacked structure in which the pairs of the first connecting terminals 4*a* to 4*c* and the second connecting terminals 6*a* to 6*c* and the isolating plates 8*a* to 8*d* are disposed alternately, i.e. the pairs of the first connecting terminals 4*a* to 4*c* and the second connecting terminals 6*a* to 6*c* are alternately interleaved with the isolating plates 8*a* to 8*d*.

In this case, inside the first connector portion 2, the isolating plates 8*a* to 8*c* are respectively fixed to the tips of the first connecting terminals 4*a* to 4*c* held to be aligned at a specified pitch. A pitch between the isolating plates 8*a*, 8*b* and 8*c* can therefore be held, even without separately providing a holding jig (see JP Patent No. 4037199) for holding the pitch between the isolating plates 8*a*, 8*b* and 8*c*. This allows the second connecting terminals 6*a* to 6*c* to be easily inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form the pairs respectively. That is, the insertability/removability of the second connecting terminals 6*a* to 6*c* is unlikely to deteriorate. Also, because of no need to provide a holding jig for holding the pitch between the isolating plates 8*a*, 8*b* and 8*c*, a further size reduction can very effectively be achieved, compared to the prior art.

Also, the contact between the first connecting terminal 4*a* (or 4*b*) and the second connecting terminal 6*a* (or 6*b*) is sandwiched between the first isolating plate 8*a* (or 8*b*) fixed to the first connecting terminal 4*a* (or 4*b*) constituting the contact, and the first isolating plate 8*b* (or 8*c*) fixed to the first connecting terminal 4*b* (or 4*c*) constituting the other contact. Likewise, the contact between the first connecting terminal 4*c* and the second connecting terminal 6*c* is sandwiched between the first isolating plate 8*c* fixed to the first connecting terminal 4*c* constituting the contact, and the second isolating plate 8*d* fixed to the inner surface of the male terminal housing 5.

Figure 9:
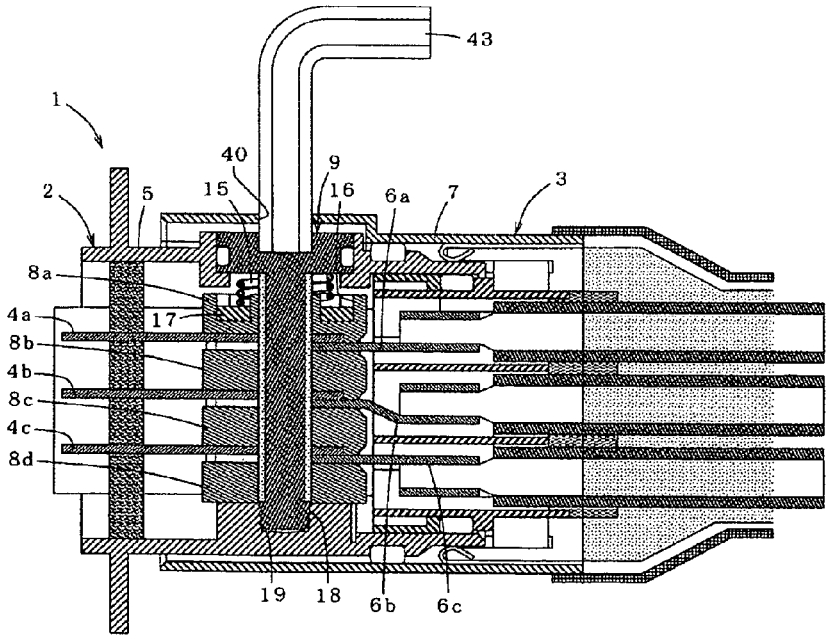
FIG. 9 is a cross-sectional view showing the connector after mating the first connector portion and the second connector portion.

Referring to FIG. 9, following that, using a manipulation tool 43 such as a wrench, the manipulation tool engaging hole 9*c* of the connecting member 9 is manipulated from the connecting member manipulation hole 40, to screw and tighten the screwing portion 18 of the connecting member 9 into the screw hole 19 of the male terminal housing 5. The connecting member 9 is then rotated and pressed into the bottom of the screw hole 19, and causes the elastic member 15 to, in turn, press the first isolating plate 8*a*, the first isolating plate 8*b*, the first isolating plate 8*c*, and the second isolating plate 8*d*, and sandwich the contacts between the isolating plates 8*a* and 8*b*, between the isolating plates 8*b* and 8*c*, and between the isolating plates 8*c* and 8*d*, respectively, with the contacts isolated from each other. In this case, by being pressed by the isolating plates 8*c* and 8*d*, the first connecting terminals 4*a* to 4*c* and the second connecting terminals 6*a* to 6*c* are slightly bent and contacted with each other, respectively, in a wide range. This allows each contact to be firmly contacted and fixed, even in a vibrational environment such as on vehicle.

In this manner, with the connector 1, using the manipulation tool 43, the manipulation tool engaging hole 9*c* of the connecting member 9 is manipulated from the connecting member manipulation hole 40 to tighten the connecting member 9, but if the connecting member 9 is manipulated before completely mating the male terminal housing 5 and the female terminal housing 7, there is the possibility of the first connecting terminals 4*a* to 4*c* and the second connecting terminals 6*a* to 6*c* being not completely contacted with each other respectively, and causing connection failure.

Manipulation Permitting Means

For that reason, in this embodiment, there is provided a manipulation permitting means for permitting manipulation for fixing the first connecting terminals 4*a* to 4*c* and the second connecting terminals 6*a* to 6*c* at the contacts therebetween respectively to the connecting member 9, when the male terminal housing 5 and the female terminal housing 7 are mated with each other in a specified mated state, or in this embodiment, are completely mated with each other.

More specifically, the manipulation permitting means is for permitting manipulation for fixing the first connecting terminals 4*a* to 4*c* and the second connecting terminals 6*a* to 6*c* at the contacts therebetween respectively to the connecting member 9, when the male terminal housing 5 and the female terminal housing 7 are mated with each other in a specified mated state, or in this embodiment, are completely mated with each other, by the female terminal housing 7 covering the manipulation tool engaging hole 9*c* when the male terminal housing 5 and the female terminal housing 7 are in an incompletely mated state, in which, the first connecting terminals 4*a* to 4*c* and the second connecting terminals 6*a* to 6*c* are not in place where the male terminal housing 5 and the female terminal housing 7 are in the specified mated state, and the first connecting terminals 4*a* to 4*c* and the second connecting terminals 6*a* to 6*c* to be paired are in contact with each other.

The manipulation permitting means comprises the manipulation tool engaging hole 9*c* formed in the head 9*b* of the connecting member 9 for engaging a specified manipulation tool, and the connecting member manipulation hole 40 formed in the female terminal housing 7, and having substantially the same diameter (shape) as the manipulation tool engaging hole 9*c*.

The connecting member manipulation hole 40 is then formed in the female terminal housing 7 so that when the male terminal housing 5 and the female terminal housing 7 are mated with each other in the specified mated state, the manipulation tool engaging hole 9*c* and the connecting member manipulation hole 40 are aligned with each other, or in this embodiment, are concentric. The manipulation permitting means is for permitting manipulation for fixing the first connecting terminals 4*a* to 4*c* and the second connecting terminals 6*a* to 6*c* at the contacts therebetween respectively to the connecting member 9, when the manipulation tool engaging hole 9*c* and the connecting member manipulation hole 40 are aligned with each other.

This results in difficulty tightening the connecting member 9 in the incompletely mated state. That is, as shown in FIG. 9, the connecting member 9 is permitted to be easily tightened in the case of the complete mating, thereby allowing the prevention of the connection failures between the first connecting terminals 4*a* to 4*c* and the second connecting terminals 6*a* to 6*c* respectively.

Advantages of the First Embodiment

As described above, in this embodiment, there is provided the manipulation permitting means for permitting manipulation for fixing the first connecting terminals 4*a* to 4*c* and the second connecting terminals 6*a* to 6*c* at the contacts therebetween respectively relative to the connecting member 9, when the male terminal housing 5 and the female terminal housing 7 are mated with each other in a specified mated state. The contacts between the connecting terminals (i.e. the first connecting terminals 4*a* to 4*c* and the second connecting terminals 6*a* to 6*c*) can easily be pressed by the connecting member 9, only when the connecting terminals (i.e. the first connecting terminals 4*a* to 4*c* and the second connecting terminals 6*a* to 6*c*) are disposed at the specified positions, respectively. Thus, the electrical connection failures are difficult to occur.

Also, in an upper surface of the first isolating plate 8*a* is formed the recessed portion which covers (accommodates) a lower portion of the elastic member 15. At the bottom of the recessed portion 16 is provided the receiving member 17 made of a metal (e.g. SUS, or the like) which receives the elastic member 15 and which is for preventing damage to the first isolating plate 8*a* formed of an insulating resin.

For that reason, the height of the elastic member 15 exposed from the upper surface of the first isolating plate 8*a* can be lowered by the amount accommodated in the recessed portion 16, and the slimming of the connector 1 can therefore be ensured, compared to the prior art. That is, the slimming of the connector 1 can be ensured, even when providing the elastic member 15.

Also, by the metallic receiving member 17 provided at the bottom of the recessed portion 16 receiving the pressing force of the elastic member 15, the elastic member 15 can be prevented from contacting the upper surface of the first isolating plate 8*a* at a small contact area and exerting an excessive force to the first isolating plate 8*a* formed of a resin, and the possibility of damaging the first isolating plate 8*a* can therefore be reduced. That is, the reliability and durability of the connector 1 can be enhanced.

Although in this embodiment, the screw hole 19 is formed at such a position as to be screwed onto the screwing portion 18 at the tip of the connecting member 9, the screwing portion 18 may be formed in the head 9*b* of the connecting member 9, and the screw hole 19 may be formed to be screwed onto the screwing portion 18 formed in the head 9*b*.

Also, although in this embodiment, the screw hole 19 is formed in the male terminal housing 5, only a through hole, not the screw hole 19 may be formed in the male terminal housing 5, and the screw hole 19 may be formed in the female terminal housing 7. Also, the screw hole 19 may be formed both in the male terminal housing 5 and the female terminal housing 7.

Also, although in this embodiment, the first connecting terminals 4*a* to 4*c* and the second connecting terminals 6*a* to 6*c* are in surface contact with each other respectively, the first connecting terminal 4*a* to 4*c* contact side surfaces to be contacted with the second connecting terminals 6*a* to 6*c* may be formed with protruding portions, and the U-shaped contacts 33 of the second connecting terminals 6*a* to 6*c* may be configured to be fitted onto these protruding portions, respectively. This configuration allows the further stabilization of the coupling force of the first connecting terminals 4*a* to 4*c* and the second connecting terminals 6*a* to 6*c*, respectively. That is, this configuration is especially effective for vibration perpendicular to the connecting member 9.

Also, although in this embodiment, the lengths of the branch tips of each U-shaped contact 33 of the second connecting terminals 6*a* to 6*c* are the same, one length thereof may be formed to be long to form a J-shaped contact. The J-shaped contact allows the second connector portion 3 to be inserted into the shaft 9*a* of the connecting member 9 obliquely relative to the cable longitudinal direction.

Although the connector 1 in this embodiment has been described, one of the features of the connector 1 in this embodiment is that, unlike a later-described connector 100 in a second embodiment, the shaft 9*a* of the connecting member 9 penetrates each contact between the plural first connecting terminals 4*a* to 4*c* and the plural second connecting terminals 6*a* to 6*c* and the plural isolating plates 8*a* to 8*d*. This configuration allows the facilitation of the constant respective positional relationships of between the first connecting terminals 4*a* to 4*c* and the second connecting terminals 6*a* to 6*c* relative to the central connecting member 9.

Second Embodiment

Figure 10:
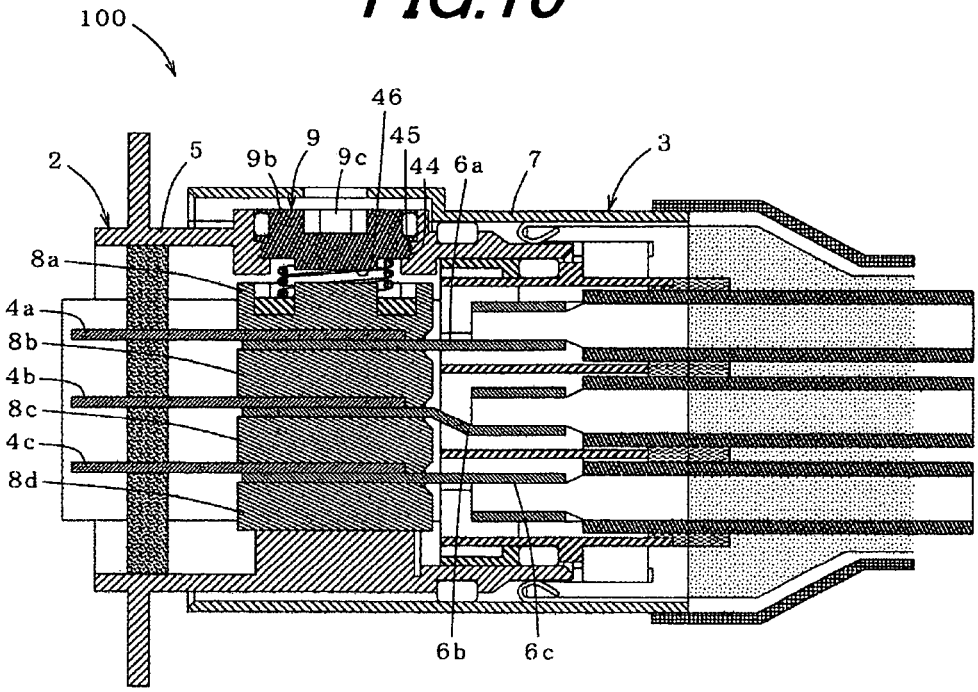
FIG. 10 is a cross-sectional view showing a connector after mating the first connector portion and the second connector portion, in a second embodiment according to the invention.

Next is described a connector 100 in a second embodiment according to the invention, referring to FIG. 10.

Connector 100 Structure

As shown in FIG. 10, the connector 100 in this embodiment is different from the previously described connector 1 in the first embodiment in that the connecting member 9 does not penetrate each contact between the plural first connecting terminals 4*a* to 4*c* and the plural second connecting terminals 6*a* to 6*c* and the plural isolating plates 8*a* to 8*d*. That is, in this embodiment, the connecting member 9 is constructed of only the head 9*b* serving as the pressing portion.

In the connector 1 in the first embodiment, the screwing portion 18 formed in the shaft 9*a* is screwed into the screw hole 19 of the male terminal housing 5 to thereby tighten the connecting member 9 into the male terminal housing 5, whereas in the connector 100 in this embodiment, the connecting member 9 is formed of only the head 9*b*, and the connector 100 is therefore configured so that a male screwing portion 44 is formed in such a manner as to push the packing 14 around the head 9*b*, while a female screw 45 into which the screwing portion 44 is screwed is cut in an inner portion of the connecting member insertion hole 26 of the male terminal housing 5, to screw the screwing portion 44 into the female screw 45 and thereby tighten the connecting member 9 into the male terminal housing 5.

As shown in FIG. 10, the head 9*b* is shaped to have a large diameter portion provided with the packing 14 and a small diameter portion formed with the male screwing portion 44, and to shape the connecting member insertion hole 26 to have those two diameter dimensions. With this configuration, when the head 9*b* is tightened into the connecting member insertion hole 26, the male screwing portion 44 is not disposed in a portion facing the packing 14. This can therefore ensure its effective waterproofing structure.

Also, on a lower surface of the head 9*b* of the connecting member 9 (on the lower surface facing the first isolating plate 8*a*) is formed an elastic member holding portion 46 for engaging and holding the elastic member 15. The elastic member 15 is held by this elastic member holding portion 46 to form a portion of the connecting member 9.

The connection of the first connecting terminals 4*a* to 4*c* and the second connecting terminals 6*a* to 6*c* using this connector 100 is performed in the same procedure as that of the previously described connector 1 in the first embodiment. That is, the mating of the first connector portion 2 and the second connector portion 3 is followed by tightening the male screwing portion 44 of the connecting member 9 into the female screw 45 of the male terminal housing 5, concurrently with this, sequentially exerting the pressing force of the elastic member 15 to the isolating plates 8*a* to 8*d*, and pressing the contacts to be sandwiched between the isolating plates 8*a* and 8*b*, 8*b* and 8*c*, and 8*c* and 8*d*, respectively, to thereby connect the first connecting terminals 4*a* to 4*c* and the second connecting terminals 6*a* to 6*c*, respectively. This allows the first connecting terminals 4*a* to 4*c* and the second connecting terminals 6*a* to 6*c* to be firmly fixed to each other respectively.

Also, in this embodiment, since the connecting member 9 does not penetrate each contact between the plural first connecting terminals 4*a* to 4*c* and the plural second connecting terminals 6*a* to 6*c* and the plural isolating plates 8*a* to 8*d*, there is no need to form the contacts of the second connecting terminals 6*a* to 6*c* in such a shape as to avoid the connecting member 9 (e.g. in the previously mentioned U-shape).

Although the connector 100 in the second embodiment has been described, one of the features of the connector 100 in the second embodiment is that, unlike the previously described connector 100 in the first embodiment, the connecting member 9 does not penetrate each contact between the plural first connecting terminals 4*a* to 4*c* and the plural second connecting terminals 6*a* to 6*c* and the plural isolating plates 8*a* to 8*d*. This configuration results from fixing the plural isolating plates 8*a* to 8*c* to the other surfaces of the plural first connecting terminals 4*a* to 4*c* respectively, and can ensure the cost reduction of the connecting member 9. Also, this leads to the weight reduction of the connecting member 9, thus allowing a contribution to the weight reduction of the entire connector.

The invention is not limited to the above-described embodiments, but various alterations are possible in the scope not departing from the gist of the invention.

Also, although in this embodiment, three phase alternating power lines have been assumed, according to the technical idea of the invention, the connector for a vehicle, for example, may be configured to collectively connect lines for different uses, such as three phase alternating current power lines for between a motor and an inverter, two phase direct current power lines for an air conditioner, and the like. This configuration allows power lines for a plurality of uses to be collectively connected by one connector. There is therefore no need to prepare a different connector for each use, to thereby allow a contribution to space saving or low cost.

Also, the terminal surfaces of the first connecting terminals 4*a* to 4*c* and the second connecting terminals 6*a* to 6*c* may be knurled to make their frictional force large, so that the terminals are thereby unlikely to move relative to each other, and are firmly fixed at the contacts therebetween respectively.

Also, although in this embodiment, when viewed from the head 9*b* of the connecting member 9, the first connecting terminals 4*a* to 4*c* and the second connecting terminals 6*a* to 6*c* have been configured to be linearly contacted with each other respectively, the male terminal housing 5 and the female terminal housing 7 may be configured so that, when viewed from the head 9*b* of the connecting member 9, the first connecting terminals 4*a* to 4*c* of the first connector portion 2 cross and contact the second connecting terminals 6*a* to 6*c* of the second connector portion 3 respectively at a right angle thereto. That is, the first connector portion 2 and the second connector portion 3 may be mated with each other in an L-shape. Likewise, the female terminal housing 7 and the second connecting terminals 6*a* to 6*c* may be configured to be disposed obliquely relative to the male terminal housing 5 and the first connecting terminals 4*a* to 4*c* respectively. By thus applying the gist of the invention, the direction of inserting/removing the second connector portion 3 relative to the first connector portion 2 may be varied. That is, the direction of drawing the cables out from the connector can be fitted to the shape of an installation portion, to thereby allow a contribution to space saving.

Also, although in this embodiment it has been described that, unlike the second connecting terminals 6*a* to 6*c*, the first connecting terminals 4*a* to 4*c* are not connected with cables respectively, the first connecting terminals 4*a* to 4*c* are not limited to this structure.

Also, although in this embodiment, the cables 27*a* to 27*c* used have excellent flexibility, rigid cables may be used.

Also, although in this embodiment, the bolt 12 has been described as the example of the connecting member 9, the connecting member 9 construction is not limited to bolt shape.

Also, although in this embodiment, the specified manipulation tool has been assumed as being a commercial manipulation tool, the specified manipulation tool may be a manipulation tool for this connector only.

Also, in this embodiment, the use orientation of the connector is such that the connecting member 9 may be substantially horizontal or substantially vertical. In other words, the use conditions of the connector in this embodiment require no use orientation.

Also, although in this embodiment, the head 9*b* of the connecting member 9 is pressed against the adjacent isolating plate 8*a* via the elastic member 15 constituting a portion of the connecting member 9, the head 9*b* may be pressed directly against the adjacent isolating plate 8*a*, not via the elastic member 15.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A connection structure, comprising:

a male terminal housing with a plurality of first connecting terminals aligned and accommodated therein;

a female terminal housing with a plurality of second connecting terminals aligned and accommodated therein;

a plurality of isolating plates aligned and accommodated in the male terminal housing;

when the male terminal housing and the female terminal housing are mated with each other, the plural first connecting terminals and the plural second connecting terminals facing each other to form pairs, respectively, and resulting in a stacked structure of the pairs of the first connecting terminals and the second connecting terminals alternately interleaved with the plural isolating plates;

a connecting member comprising a head and a shaft connected to the head, the shaft penetrating each contact between the plural first connecting terminals and the plural second connecting terminals and the plural isolating plates, the head pressing the adjacent isolating plate, to thereby collectively fix the plural first connecting terminals and the plural second connecting terminals at the contacts therebetween, for electrical connections between the plural first connecting terminals and the plural second connecting terminals, respectively, at least a portion of the connecting member, which penetrates each contact, being formed of an insulating material; and manipulation permitting means for permitting manipulation of the connection member for collectively fixing the plural first connecting terminals and the plural second connecting terminals at the contacts therebetween respectively, when the male terminal housing and the female terminal housing are mated with each other in a specified mated state.

2. A connection structure, comprising:

a male terminal housing with a plurality of first connecting terminals aligned and accommodated therein;

a female terminal housing with a plurality of second connecting terminals aligned and accommodated therein;

a plurality of isolating plates aligned and accommodated in the male terminal housing;

when the male terminal housing and the female terminal housing are mated with each other, the plural first connecting terminals and the plural second connecting terminals facing each other to form pairs, respectively, and resulting in a stacked structure of the pairs of the first connecting terminals and the second connecting terminals alternately interleaved with the plural isolating plates;

a connecting member comprising a head for pressing the adjacent isolating plate, to thereby collectively fix the plural first connecting terminals and the plural second connecting terminals at the contacts therebetween, for electrical connections between the plural first connecting terminals and the plural second connecting terminals, respectively; and manipulation permitting means for permitting manipulation of the connection member for collectively fixing the plural first connecting terminals and the plural second connecting terminals at the contacts therebetween respectively, when the male terminal housing and the female terminal housing are mated with each other in a specified mated state.

3. The connection structure according to claim 2, wherein the manipulation permitting means comprises a manipulation tool engaging hole formed in the head of the connecting member, into which is engaged a specified manipulation tool, and a connecting member manipulation hole formed in the female terminal housing, and having substantially the same size shape as the manipulation tool engaging hole, wherein the connecting member manipulation hole is formed in the female terminal housing so that when the male terminal housing and the female terminal housing are mated with each other in the specified mated state, the manipulation tool engaging hole and the connecting member manipulation hole are aligned with each other, and wherein the manipulation permitting means permits manipulation for fixing the plural first connecting terminals and the plural second connecting terminals at the contacts therebetween respectively to the connecting member, when the manipulation tool engaging hole and the connecting member manipulation hole are aligned with each other.

4. The connection structure according to claim 2, further comprising:

a metallic elastic member for, when the connecting member is inserted into the male terminal housing, being disposed between the head and the isolating plate disposed directly below the head, the elastic member applying a specified pressing force to that isolating plate disposed directly below the head, to press the plural isolating plates sequentially in a stacking direction; and a recessed portion for accommodating a lower portion of the elastic member pressing that isolating plate, the recessed portion being formed in an upper surface of that isolating plate disposed directly below the head.

5. The connection structure according to claim 4, further comprising:

a metallic receiving member for receiving the elastic member, the receiving member being provided at the bottom of the recessed portion.

6. The connection structure according to claim 2, further comprising:

a connecting member insertion hole for inserting the connecting member, the connecting member insertion hole being formed in the male terminal housing; and a waterproofing structure for sealing between an outer surface of the head and an inner surface of the connecting member insertion hole in the male terminal housing, the waterproofing structure being provided in an outer surface of the head of the connecting member.

7. The connection structure according to claim 6, wherein the connecting member insertion hole is formed in a cylindrical shape, and bent inward at an end of the cylindrical shape facing into the male terminal housing, and a rim of a lower surface of the head of the connecting member is contacted with the bent end of the connecting member insertion hole, to thereby regulate the stroke of the connecting member.

8. The connection structure according to claim 2, wherein the plural second connecting terminals are connected with flexible cables, respectively, at one end, and the female terminal housing further comprises a cable holding member for holding the cables, so that the plural second connecting terminals are held at specified positions, respectively, with flexibility relative to the female terminal housing.

* * * * *